US005653443A

United States Patent [19]

Ervin

[11] Patent Number: 5,653,443

[45] Date of Patent: Aug. 5, 1997

[54] ROTATABLE CRIBBAGE BOARD

[76] Inventor: David B. Ervin, 484 Bimini La., Indian Harbor Beach, Fla. 32937

[21] Appl. No.: 629,502

[22] Filed: Apr. 9, 1996

[51] Int. Cl.[6] ..... A63F 3/00

[52] U.S. Cl. ..... 273/248; 273/280

[58] Field of Search ..... 273/236, 242, 273/243, 248, 249, 280

[56] References Cited

U.S. PATENT DOCUMENTS

| | | | |
|---|---|---|---|
| D. 291,070 | 7/1987 | Watson | D10/46.1 |
| D. 291,417 | 8/1987 | Morgan | D10/46.1 |
| D. 297,897 | 10/1988 | Stackhouse | D7/2 |
| D. 301,956 | 7/1989 | Newton | D7/2 |
| D. 311,707 | 10/1990 | Clements | D10/46.1 |
| D. 322,011 | 12/1991 | Asner | D7/501 |
| 3,520,536 | 7/1970 | Kindelan | 273/248 |
| 3,905,547 | 9/1975 | Cyre et al. | 235/90 |
| 4,014,547 | 3/1977 | Gomez et al. | 273/280 X |
| 4,123,058 | 10/1978 | Furyk et al. | 273/280 X |
| 4,598,912 | 7/1986 | Kendrick et al. | 273/245 |
| 4,854,586 | 8/1989 | Morse | 273/249 |
| 4,902,018 | 2/1990 | Morse | 273/249 |
| 4,986,295 | 1/1991 | Kellner | 135/66 |
| 5,050,888 | 9/1991 | Schultz et al. | 273/248 |
| 5,090,106 | 2/1992 | Fink | 29/525 |
| 5,318,299 | 6/1994 | Beaster et al. | 273/280 X |
| 5,356,153 | 10/1994 | Morse | 273/248 |
| 5,407,206 | 4/1995 | Cohen | 273/249 |
| 5,498,005 | 3/1996 | Jacques | 273/248 |

FOREIGN PATENT DOCUMENTS

| | | | |
|---|---|---|---|
| 3204010 | 8/1983 | Germany | 273/280 |
| 2185894 | 8/1987 | United Kingdom | 273/280 |

*Primary Examiner*—William E. Stoll

*Attorney, Agent, or Firm*—Brian S. Steinberger; Law Office of Brian S. Steinberger

[57] ABSTRACT

A rotatable cribbage game board allows players to make their successive turns without getting up from their seats and without having to physically move the entire game board. The novel game board has a top wooden member rotatable relative to a stationary base wooden member. Optionally the board can be formed from molded plastic. The base member has a first storage compartment for playing cards and a second storage compartment for scoring inserts such as pegs, toothpicks, and matchsticks. The top member has an upper cribbage board surface with an inner concentric row having one hundred twenty-two holes, a middle concentric row having one hundred twenty-three holes, and an outer concentric row having one hundred twenty-two holes. Optionally these concentric holes can be arranged in a spiral pattern. Furthermore, the top member can include circular indentations for holding beverages. The bottom of the top member has a centrally located downward protruding post. Annular ball beatings are mounted in the base member for receiving the protruding post which allows the top member to rotate relative to the base member. Access to the first storage compartment and the second storage compartment is by completely separating the top member from the base member. An optional third storage compartment can be used for holding dice and the like.

19 Claims, 6 Drawing Sheets

Fig. 1A
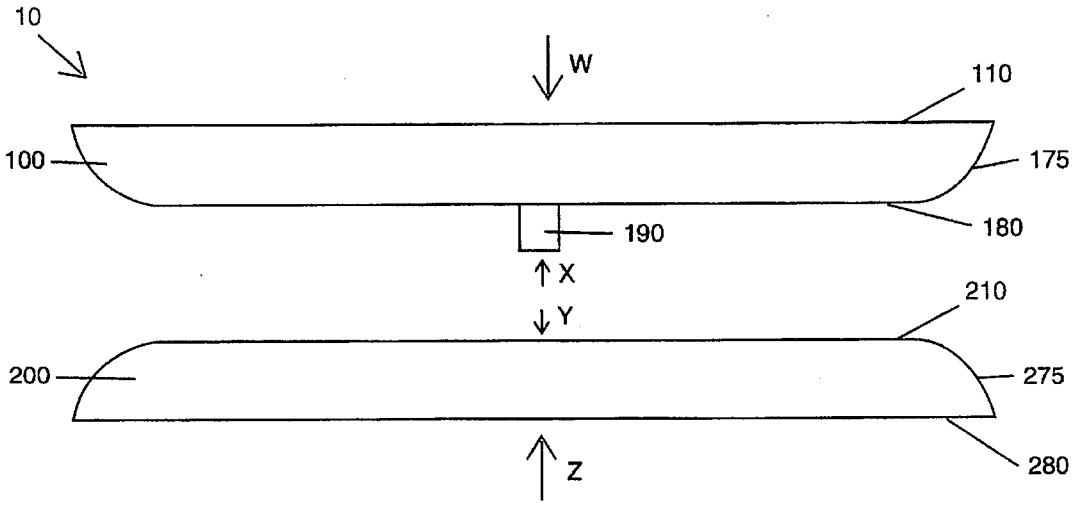
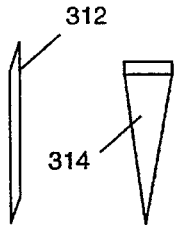
Fig. 1B
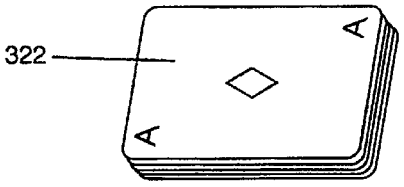
Fig. 1C
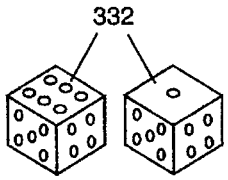
Fig. 1D

ROTATABLE CRIBBAGE BOARD

This invention relates to a game board, and in particular to a novel cylindrical cribbage board having a top portion rotatable in a Lazy Susan fashion over a stationary bottom portion, wherein the top portion is removable to allow playing cards and pegs to be stored therein.

BACKGROUND AND PRIOR ART

Cribbage is a well known card game for at least two players in which the object is to make counting combinations for points that are scored on a small board having holes for pegs. Cribbage game boards have been proposed over the years that have holes for holding and storing the pegs, and some further for holding playing cards and dice. Various types of cribbage boards use rows of holes for holding the pegs where the object of the game is for each player to go from the beginning of one row to the end of the row. See U.S. Pat. No. 3,905,547 to Cyre et al.; U.S. Pat. No. 4,598,912 to Kendrick et al.; U.S. Pat. No. 4,854,586 and U.S. Pat. No. 4,902,018 to Morse; U.S. Pat. No. 4,986,295 to Kellner; U.S. Pat. No. 5,090,106 to Fink; U.S. Pat. No. 5,407,206 to Cohen; and Des. U.S. Pat. No. 291,070 to Watson.

Problems with the above types of cribbage boards can be numerous. For example, card storage holders may be difficult to access. The Cohen patent '206 requires the folding back of a hinged wall in FIG. 2 to access the cards which would result in pegs on the upper surface of the board falling off the surface. The Fink '106 patent has a surface indentation for holding cards based on gravity. However, when the game is not being played the cards in the constantly exposed cards in the Fink device can become dislodged, fall out and become lost.

Other problems occur when each player takes their turn on a game board. Because the above boards are generally stationary and immobile, the board itself has to be moved or each player must physically move from their seats, and reach across the board. When two or more players are sitting around a table or are sitting on the floor, the players can find it uncomfortable and undesirable to constantly rise from one's seat and/or constantly move the board when their turn comes up. Furthermore, this moving can also result in losing pegs, cards, dice and the like from the game. This problem becomes compounded each time there is an additional player. While, the Cyre et al. '547 patent on first glance appears to be a circular disc cribbage board, this patent is limited to a complex counter disc with a numbering scale and does not use pegs and the like for traditional scoring. Furthermore, the Cyre et '547 patent has not place for card, peg and dice storage.

Thus, the need exists for a cribbage board that overcomes for the deficiencies cited above.

SUMMARY OF THE INVENTION

The first objective of the present invention is to provide a cribbage board that allows players to play their turn without having to physically move the entire board.

The second object of this invention is to provide a cribbage board that allows players to play their turn without having to physically get up from their original sitting position.

The third object of this invention is to provide a rotatable cribbage board having a stationary base and a rotating game board section.

The fourth object of this invention is to provide a rotatable cribbage board having a secure storage area for holding playing cards.

The fifth object of this invention is to provide a rotatable cribbage board having a secure storage area for holding pegs.

The sixth object of this invention is to provide a rotatable cribbage board having a secure storage area for holding dice.

A preferred embodiment of the rotatable cribbage game board invention includes a circular stationary base member having a first storage compartment for playing cards and a second storage compartment for scoring inserts such as pegs, toothpicks, and matchsticks. A circular top member has an upper cribbage board surface with three concentric rows of holes: an inner concentric row having one hundred twenty-two holes, a middle concentric row having one hundred twenty-three holes, and an outer concentric row having one hundred twenty-two holes. Optionally, the upper surface can include circular indentations having cork material absorbers for drink glasses and a rectangular indentation for cards. The bottom of the top member has a centrally located downward protruding post. Annular ball bearings mounted in the base member receives the protruding post allowing the top member to rotate relative to the base member. Cribbage game players play their individual turn by moving the scoring inserts within the holes of the concentric rows while remaining seated. Access to the first storage compartment and the second storage compartment is by completely separating the top member from the base member. An optional third storage compartment in the base member can be used for holding other playing pieces such as dice and the like. While the preferred embodiment describes the base member and the rotating top member as being formed from wood, other materials such as injection molded plastic can also be used.

Further objects and advantages of this invention will be apparent from the following detailed description of a presently preferred embodiment which is illustrated schematically in the accompanying drawings.

BRIEF DESCRIPTION OF THE FIGURES

FIG. 1A is an exploded view of the rotatable upper member separated from the stationary base member.

FIG. 1B illustrates the peg/toothpick player inserts that can be used with the subject invention.

FIG. 1C illustrates the playing cards that can be used with the subject invention.

FIG. 1D illustrates the optional dice that can be used with the subject invention.

DESCRIPTION OF THE PREFERRED EMBODIMENT

Figure 2A:
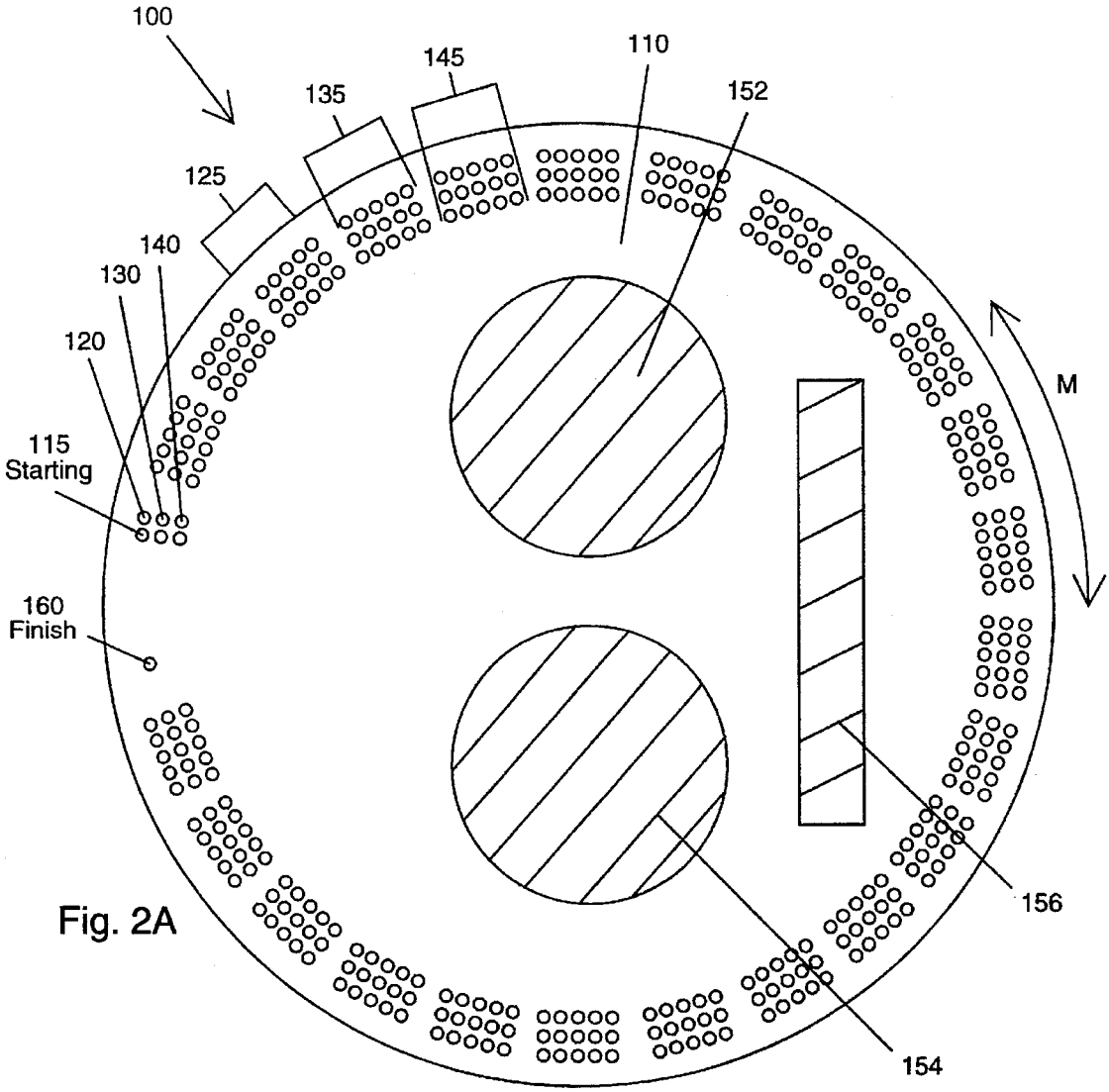
FIG. 2A is a top view of the invention of FIG. 1A along arrow W.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

A description of each of the figures will now be described. FIG. 1A is an exploded view of it preferred embodiment 10 of the invention having the rotatable circular upper member 100 separated from the stationary base member 200. Upper member includes a flat top 110, curved rounded sides 175 and a flat bottom side 180 having a centrally located support post 190 protruding downward therefrom. Lower stationary base member 200 includes a flat top 210, curved rounded sides 275 and a flat bottom 280. In a preferred embodiment both upper member 100 and lower member 200 can be carved out of wood, and the like. Types of wood include but are not limited to maranti, mahogony, oak, and pine. FIG. 1B illustrates the toothpick 312 and peg(such as a golf tee) 314 player inserts that can be used in embodiment 10 of FIG. 1A. FIG. 1C illustrates the playing cards 322 that can be used with embodiment 10 of FIG. 1A. FIG. 1D illustrates the optional dice 332 that can be used with embodiment 10 of FIG. 1A.

FIG. 2A is a top view 110 of the upper member 100 of FIG. 1A along arrow W. In a preferred embodiment there is an outer circular row 120, a middle concentric row 130, and an inner concentric row 140 of drilled out holes. Each row has twenty-four sets of five holes 125, 135, 145, arranged in a circular pattern about the top side 110 of upper member 100, so that each row has one hundred-twenty holes. Each row 120, 130, 140 has an additional two holes at the starting point 115 so that each of the three players can have two pegs/toothpicks when they begin playing. Top side 110 can have an outer diameter of approximately fourteen inches. In some cribbage games each player has a different set of colored pegs at the start of the game. An extra hole 160 is arranged adjacent to the final middle row to signify the finish line. Optional circular hole indentations 152, 154 can be cut-out for holding drinking glasses, cans, and the like, and a rectangular cut-out indentation for holding playing cards. The indentations 152, 154 can include a layer of absorbent cork material.

Figure 2B:
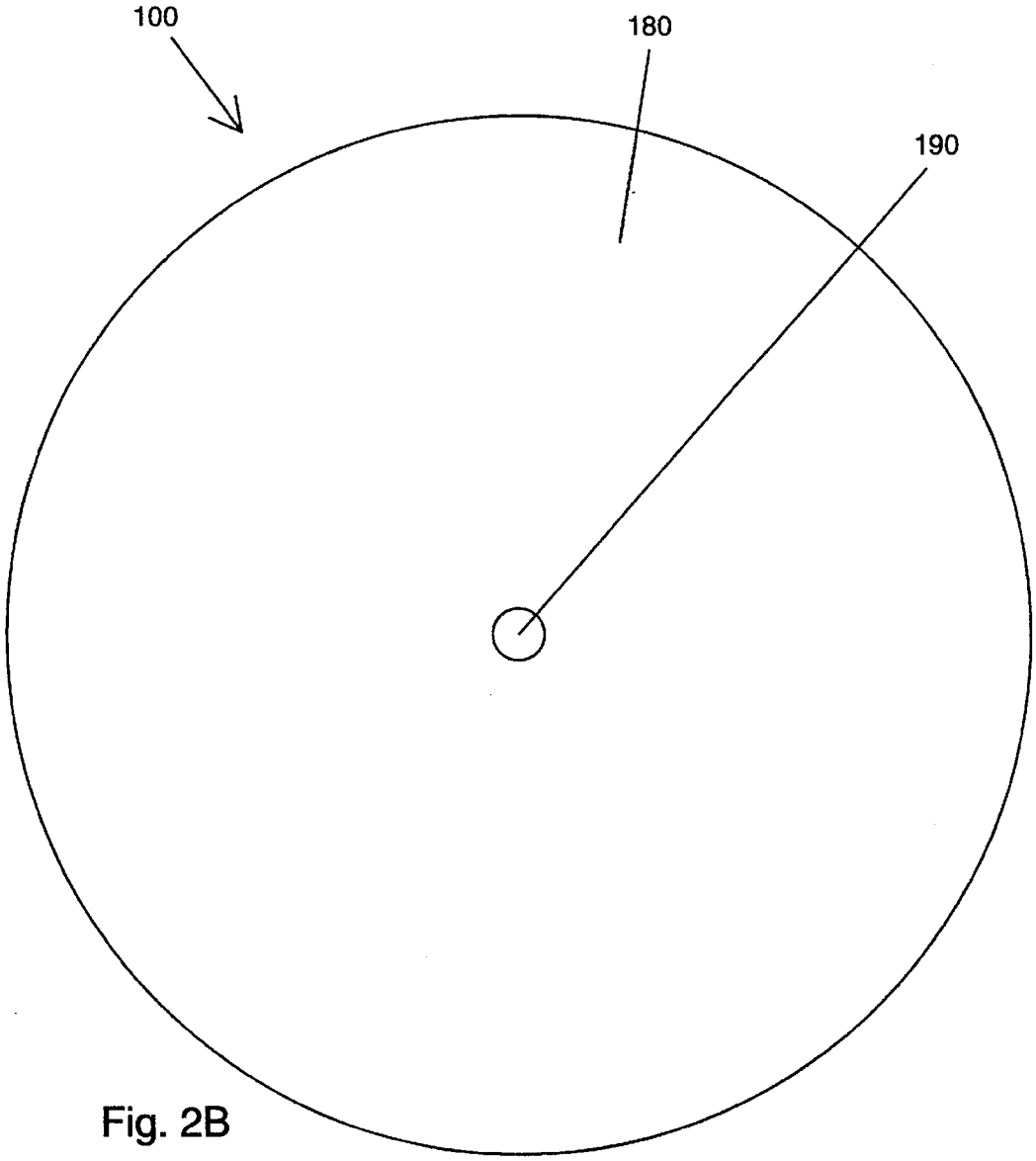
FIG. 2B is a bottom view of the upper member of the invention of FIG. 1A along arrow X.

FIG. 2B is a bottom view 180 of the upper member 100 of the invention 10 of FIG. 1A along arrow X. Bottom view 180 illustrates the circular shape of upper member 100 and inches a centrally located post 190.

Figure 2C:
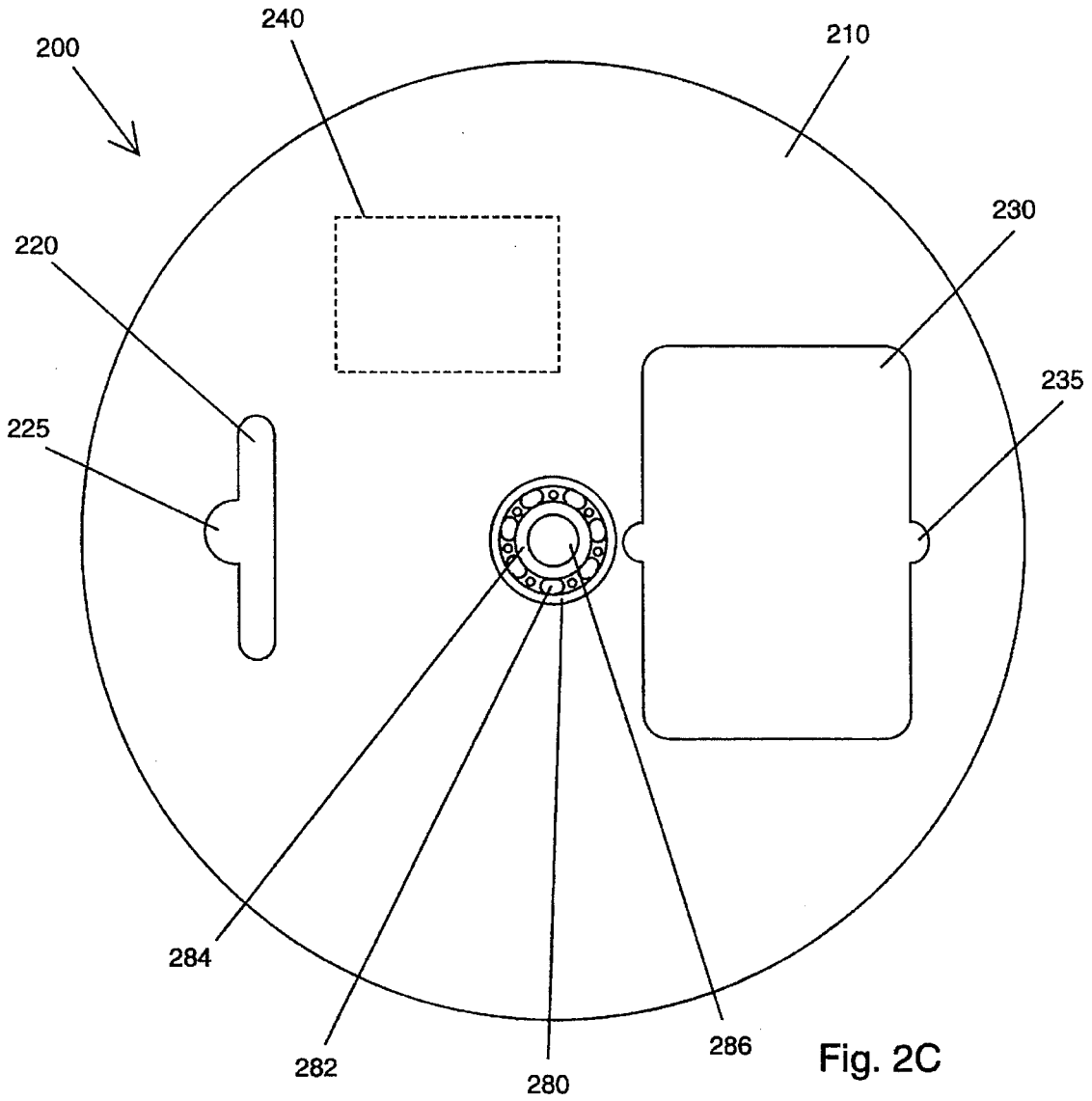
FIG. 2C is a top view of the base member of the invention of FIG. 1A along arrow Y.
Figure 2D:
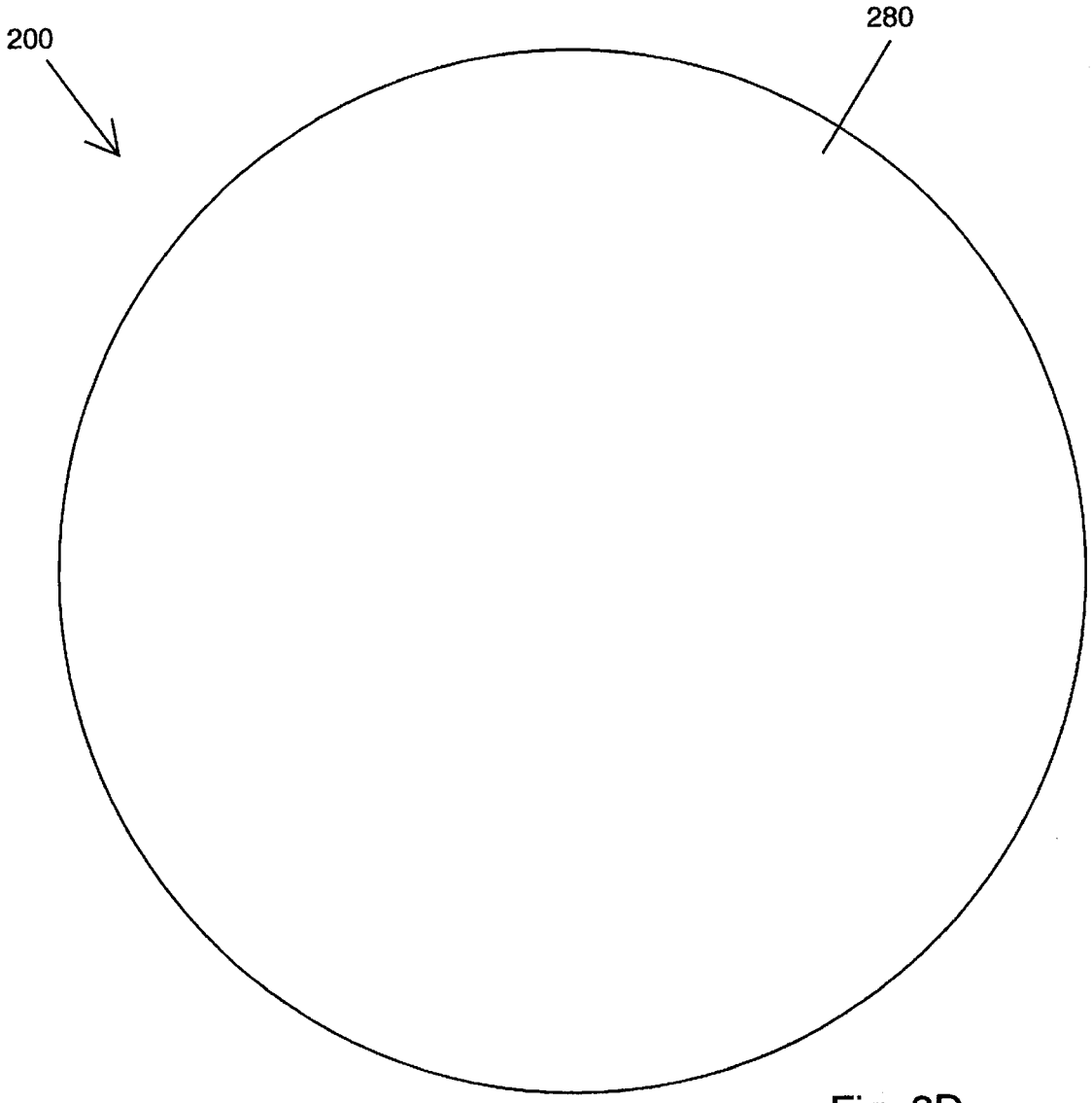
FIG. 2D is a bottom view of the base member of the invention of FIG. 1A along arrow Z.

FIG. 2C is a top view 210 of the base member 200 of the invention 10 of FIG. 1A along arrow Y. Top surface 210 includes a longitudinal cut-out opening 220 for toothpicks/pegs (312, 314 shown in FIG. 1B) with a side indentation 225 for allowing someone removing the toothpicks/pegs to insert a finger therein. A larger rectangular cut-out opening 230 is sized for playing cards(322 shown more clearly in FIG. 1C) with side indentations 235 for allowing the insertion of one's finger to aid in removing the cards. An optional square cut-out opening 240 can be included for dice(332 shown more clearly in FIG. 1D). In the middle area of the top side 210 of base member 200 is a cylindrical cut-out opening in which a metal cylinder 280 is fitted therein. Ball bearings 282 and a rotating inner metal cylinder 284 have a central cylindrical opening 286 that is sized to loosely receive the protruding post 190 of FIGS. 1A and 2B. FIG. 2D is a bottom view 280 of the circular base member 200 of the invention of FIG. 1A along arrow Z. Base member can sit on a flat surface such as the floor, a table and the like.

Referring to FIGS. 1A–2D, post 190 of upper member 100 is fit into cylindrical opening 286 of stationary base member 200. At the beginning of a game, upper member 100 is lifted vertically up and completely separated from base member 200 allowing the playing cards, pegs/toothpicks and dice to be removed. During the game, post 190 of upper member 100 is fit into cylindrical receiving opening 286. Successive players can then turn upper member 100 in either direction along arrow M, so that no player has to physically move from their initial seated position, which also reduces the chances of losing toothpicks/pegs 312, 314, playing cards 322 and optional dice 332.

Figure 3:
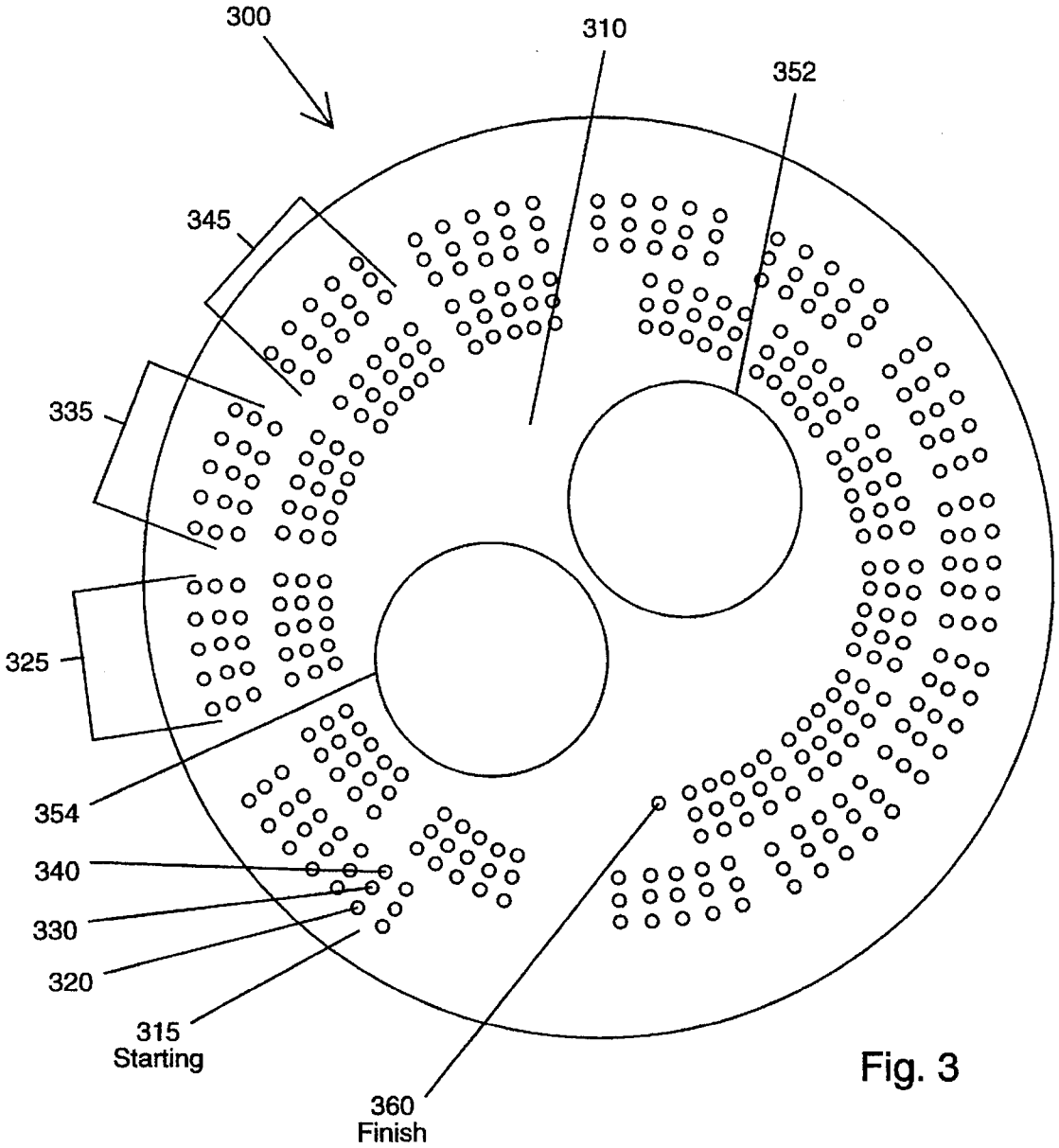
FIG. 3 illustrates a second embodiment top view of the invention with a spiral hole pattern.

FIG. 3 illustrates a second embodiment top view of the invention 300 with a spiral hole pattern 310 where the outer diameter of the top can be approximately twelve inches. Dual peg holes 320, 330, 340 can be cut for the starting position 315. Similar to FIG. 2A, five set hole patterns 325,335, 345 can be cut for each player around the top of the board. Circular hole indentations 352, 354 with cork material layers can be optionally cut into the top 300 for holding drink glasses, and beverage cans.

Although the preferred embodiments have been described as having a circular board diameter of twelve and fourteen inches, other sizes can be made such as but not limited to eight, ten, twenty-four inches and the like.

While the embodiment has been describe using ball bearings, other type of bearings can be used such as but not limited to tapered roller bearings, inlaid bearings and generic bearings.

Although the preferred embodiment shows three concentric rows of holes for three players, four, five or more rows can be used for games having four, five or more players.

While the preferred embodiment describes storage compartments for cards and pegs/matches/pins, separate storage compartments can be incorporated for dice and the like.

Although the preferred embodiment is described as made from wood, the invention can be equally made from other materials such as but not limited to injection molded plastic, and the like.

While the preferred embodiment is described for use with pegs, other types of scoring inserts such as but not limited to matchsticks, toothpicks, pins, and pencils can be used.

Although the preferred embodiment is described for use with Cribbage, other types of board games where the board can be used for score keeping can be played with the invention such as but not limited to Euchre, black jack, poker and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fail within the breadth and scope of the claims here appended.

I claim:

1. A rotatable game board comprising:

a circular and stationary base member;

a circular top member having an exposed upper game board surface with exposed concentric rows of holes;

a rotating means for allowing the top member to rotate relative to the base member allowing board game players to play their by moving inserts within the holes of the concentric rows while remaining seated;

a first storage compartment in an upper surface of the base member for storing playing cards; and a second storage compartment in the upper surface of the base member for storing the hole inserts, wherein the first storage compartment and the second storage compartment are accessible by completely separating the top member from the base member.

2. The rotatable game board of claim 1, wherein the game board is for:

cribbage.

3. The rotatable game board of claim 1, wherein the stationary base member and the top member are formed from:

wood.

4. The rotatable game board of claim 1, wherein the stationary base member and the top member are formed from:

plastic.

5. The rotatable game board of claim 1, wherein the inserts are chosen from at least one of:

pegs, toothpicks, and matchsticks.

6. The rotatable game board of claim 1, wherein the rotating means includes:

a centrally located post connected and protruding beneath the top member; and rotatable ball beatings in a central region of an upper surface of the base member for receiving the post.

7. The rotatable game board of claim 1, wherein the circular top member further includes:

circular indentations for holding beverages.

8. The rotatable game board of claim 1, wherein the concentric rows of holes includes:

three concentric rows, with at least one row having one hundred twenty-one holes.

9. A rotatable cribbage game board having storage compartments for playing cards and for scoring inserts, the game board comprising:

a circular and stationary base member, the base member having a first storage compartment in an upper surface for storing playing cards and a second storage compartment in the upper surface for storing scoring inserts;

a circular top member having an upper cribbage board surface with concentric rows of holes, and a lower surface having a centrally located downward protruding post; and a rotating means in the base member for receiving the protruding post, and allowing the top member to rotate relative to the base member, wherein cribbage game players play their individual turn by moving the scoring inserts within the holes of the concentric rows while remaining seated, and wherein the first storage compartment and the second storage compartment are accessible by completely separating the top member from the base member.

10. The rotatable cribbage game board of claim 9, wherein the rotating means includes:

ball bearings in the upper surface of the base member.

11. The rotatable game board of claim 9, wherein the stationary base member and the top member are formed from materials chosen from at least one of:

wood and plastic.

12. The rotatable game board of claim 9, wherein the inserts are chosen from at least one of:

pegs, toothpicks, and matchsticks.

13. The rotatable game board of claim 9, wherein the concentric rows of holes includes:

three concentric rows, with at least one row having one hundred twenty-one holes.

14. The rotatable game board of claim 9, wherein the concentric rows of holes includes:

an inner concentric row having one hundred twenty-two holes;

a middle concentric row having one hundred twenty-three holes; and an outer concentric row having one hundred twenty-two holes.

15. The rotatable cribbage game board of claim 9, further comprising:

a third storage compartment in the upper surface of the base member for storing dice.

16. A rotatable game board comprising:

a circular and stationary base member;

a circular top member having an exposed upper game board surface with exposed spiral rows of holes; and a rotating means for allowing the top member to rotate relative to the base member allowing board game players to play their turn by moving inserts within the holes of the spiral rows of holes while remaining seated.

17. The rotatable game board of claim 16, wherein the rotating means includes:

a centrally located post connected and protruding beneath the top member; and rotatable ball bearings in a central region of an upper surface of the base member for receiving the post.

18. The rotatable game board of claim 16, further comprising:

a first storage compartment in an upper surface of the base member for storing playing cards; and a second storage compartment in the upper surface of the base member for storing the hole inserts, wherein the first storage compartment and the second storage compartment are accessible by completely separating the top member from the base member.

19. The rotatable cribbage game board of claim 18, further comprising:

a third storage compartment in the upper surface of the base member for storing dice.

* * * * *